United States Patent [19]

Tandy et al.

[11] Patent Number: 4,909,699

[45] Date of Patent: Mar. 20, 1990

[54] FREIGHT DISCHARGE OF RAILWAY WAGONS

[75] Inventors: David W. Tandy, Bury, England; Geoffrey Laycock, Richmond, Great Britain

[73] Assignee: The Standard Railway Wagon Company Limited, Lancashire, United Kingdom

[21] Appl. No.: 310,638

[22] Filed: Feb. 13, 1989

[30] Foreign Application Priority Data

Feb. 17, 1988 [GB] United Kingdom ..... 8803593

[51] Int. Cl.[4] ..... B65G 21/00

[52] U.S. Cl. ..... 414/528; 414/505; 414/339; 414/343; 414/353; 198/371; 198/586; 198/606

[58] Field of Search ..... 414/332, 339, 340, 343, 414/353, 501, 502, 503, 505, 528, 574; 198/303, 371, 586, 606, 607

[56] References Cited

U.S. PATENT DOCUMENTS

| | | | |
|---|---|---|---|
| 2,420,009 | 5/1947 | Osgood | 198/314 X |
| 2,507,341 | 5/1950 | Lee | 414/528 |
| 3,842,994 | 10/1974 | Theurer et al. | 414/339 |
| 4,795,264 | 1/1989 | Riker | 414/528 X |
| 4,795,301 | 1/1989 | Snead et al. | 414/528 X |

FOREIGN PATENT DOCUMENTS

| | | | |
|---|---|---|---|
| 2403010 | 7/1975 | Fed. Rep. of Germany | 414/343 |

*Primary Examiner*—Robert J. Spar
*Assistant Examiner*—John Vanden Bosche
*Attorney, Agent, or Firm*—Salter & Michaelson

[57] ABSTRACT

A freight discharge assembly particularly for a unit of railway hopper wagons (10) comprising an endless conveyor (30) arranged to run under the hoppers to receive material falling from the hoppers under gravity, a drive drum (36) at each end of the unit for selectively driving the endless belt in either direction each drive drum being mounted on arms (38) pivotally mounted on the unit whereby each loop of the endless belt around each drum (36) can be moved away from the unit.

9 Claims, 7 Drawing Sheets

FREIGHT DISCHARGE OF RAILWAY WAGONS

This invention relates to a freight discharge assembly for railway wagons.

The transport of minerals such as coal or stone by rail is extremely efficient. Moreover it does not harm the environment in the same way as happens if equivalent loads are conveyed by road transport. However, one of the longstanding problems with transport of minerals by rail is unloading the train when it has arrived at its destination. In the past special installations had to be built for receiving mineral from railway wagons. These installations are expensive and, therefore, it is the practice only to build them in places where mineral deliveries were likely to be required for a long period of time, for example for delivery of coal at a power station, where the heavy investment in the installation could be justified.

In order to avoid the expense of special installations for receiving minerals it has been proposed to provide a unit set of rail hopper wagons permanently coupled together with a conveyor extending along the length of the unit upon which mineral material from the hopper wagons can be dropped under gravity. The conveyor moves the mineral material to one end of the set of wagons and onto a transfer conveyor on a transfer car. The transfer conveyor can be swung out to one or other side of the track. In this way the entire load of the set of wagons can be deposited at a single location at the side of the railway line and no special lineside equipment is required.

Although the above described arrangement overcomes the problem of expensive lineside unloading installations it is still not suitable for operation in all circumstances. There are two major problems. The first of these is the requirement for the wagons to be permanently coupled together. Many rail networks place a limit on the length of permanently coupled unit trains, mainly because existing workshops can only service a train of wagons up to a limited length. This condition limits the amount of mineral freight that can be transported by the train. The second major problem is that the conveyor in the previously proposed equipment can only move the mineral material in one direction. For flexibility of operation, and to avoid having to turn the entire train around—a difficult operational problem in itself—the material has to be movable to either end of the train. Any solution to that problem creates yet another difficulty. The transfer car in the known equipment is also permanently coupled to the set of hopper wagons. It has to be because the end of the conveyor is actually located on the transfer car above the lower end of the transfer conveyor. If the conveyor is to be movable in either direction a second transfer car would have to be provided at the other end of the train. As it is the permanent coupling of one transfer car to the hopper wagons is economically unacceptable. Whenever possible the transfer car needs to be separated from the hopper wagons so that the dead weight of the transfer car is not being moved unnecessarily. Two permanently coupled transfer cars would be economically hopeless.

The present invention has been made with these, and other, problems in mind.

According to the invention there is provided a freight discharge assembly for a unit of one or more freight wagons, comprising an endless conveyor provided on said unit, means for driving the endless conveyor in either direction, means provided at each end of the unit to move the extremity of the endless conveyor loop between a first position adjacent the unit and a second position projecting from the unit.

In a preferred embodiment of the invention the unit comprises one or more hopper wagons. An endless belt is arranged to run along the unit beneath the hoppers so that material from the hoppers can fall onto the belt under gravity. At each end of the unit the endless belt is led around a roller mounted on an arm pivotable to move the end of the conveyor loop between the said first and second positions. The said rollers at the ends of the unit are selectively drivable in opposite senses and adapted to free wheel in the reverse direction. Thus the belt can be moved in either direction. It is particularly preferred that the endless belt length and/or tension is such that the belt end at only one end of the unit can be moved into the second position.

A specific embodiment of the invention will now be described by way of example with reference to the accompanying drawings in which.

Figure 1:
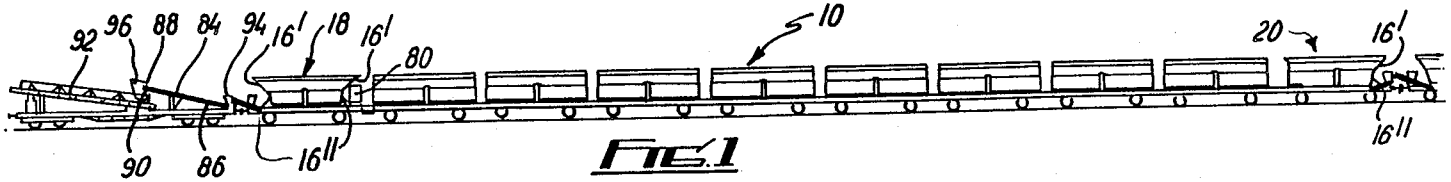
FIG. 1 is a diagrammatic view in side elevation of a freight train fitted with the invention.

Referring to the drawings a plurality of hopper wagons (ten in the embodiment being described) are "permanently" coupled together to form a unit 10. Each wagon in the unit is a hopper wagon comprising a body having side walls 14 and end walls 16. The upper part 14' of each side wall is substantially vertical whereas the lower parts 14" of the side walls are mutually inclined towards each other. Except for the end wagons 18, 20 in the ten wagon unit the end walls 16 of the wagons are substantially vertical. The end walls of end wagon 18 include an upper part 16' inclined to the vertical by an angle of about 45° and a lower part 16" which is inclined to the vertical by a smaller angle. A similar arrangement is provided for the outer end wall of the other end wagon 20, that is the end wall of wagon 20 that is remote from the rest of the unit.

The inclined end walls 16' and 16" of the end wagon are provided for the purpose of defining a space on the wagon chassis to accommodate other equipment and are not designed specifically to assist discharge of material from the hopper wagons. Other configurations of end wall 16 for the end wagons can be adopted provided they also leave sufficient space for equipment (as will be described hereinafter) and provided they do not positively impede flow of material under gravity from the hopper wagon body.

Each hopper wagon body is supported on a chassis 21 by support framework 22 and the chassis is suspended on fixed axis 24 to which the wagon wheels 26 are journalled. It is to be understood that the invention is not limited to wagons with fixed axles, but can be applied to bogie wagons.

An endless belt 30 extends along the entire length of each ten wagon unit between the bottom of each hopper wagon body and the wagon chassis. The belt is supported along its upper run by rollers 32 which permit the upper surface of the upper run of the belt to adopt a dished or concave configuration. The lower run of the endless belt is also supported on rollers 34 but the shape of the lower run is of less importance.

Figure 6:
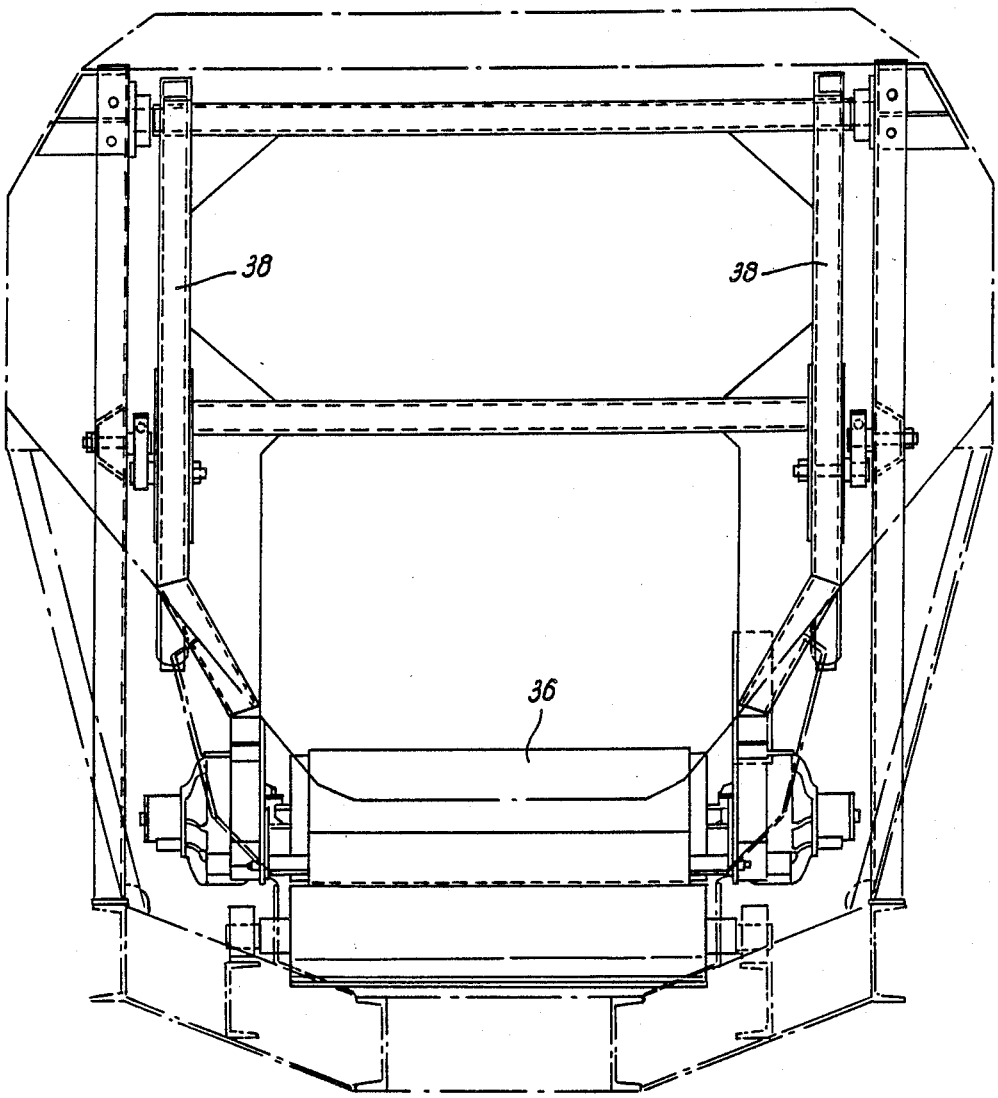
FIG. 6 is an end view of a unit.

At each end of the ten wagon unit the endless belt 30 is led around a powered drive drum 36. The arrangement is the same at each end of the unit so the assembly at one end only will now be described with reference to FIG. 3. The drive drum 36 is rotatably mounted at the lower ends of spaced-apart, cranked arms 38. The upper ends of arms 38 are pivotally mounted at 40 adjacent the top of vertical frame members 42. The vertical frame members 42 are supported by struts 44 fixed thereto and to the end 16 of the hopper wagon body. As can be seen in FIG. 6 the lower parts of each arm 38 are inclined towards each other so that the spacing between the upper parts of arms 38 is wider than the drum 36. The reason for this will become apparent.

The drum 36 is drivable in one sense and adapted to free wheel in the opposite sense. At the end of the unit illustrated in FIG. 3 the drum is drivable in the anti-clockwise direction so as to move the upper run of the endless belt 30 towards the left (as viewed in the drawing). The drum at the other end of the unit is drivable in the clockwise direction adapted to free wheel in the reverse sense. Thus if the upper run of the endless belt is to be moved towards the right (as viewed in FIG. 3) the said other drum is driven clockwise and drum 36 shown in FIG. 3 free wheels in the clockwise sense.

Hydraulic rams 46 are pivotally connected at one end to the lower part 16'' of the hopper wagon body and at their other ends pivotally connected to plate 48 located about mid way along the cranked arms 38. A pair of links 50 are also pivotally connected at one end 47 to each plate 48. A slot 52 extends from adjacent the other end of each link to about two thirds along the length of the link 50. A pin 54 mounted on a plate fixed to the adjacent vertical frame member 42 extends through the slot 52.

Figure 3:
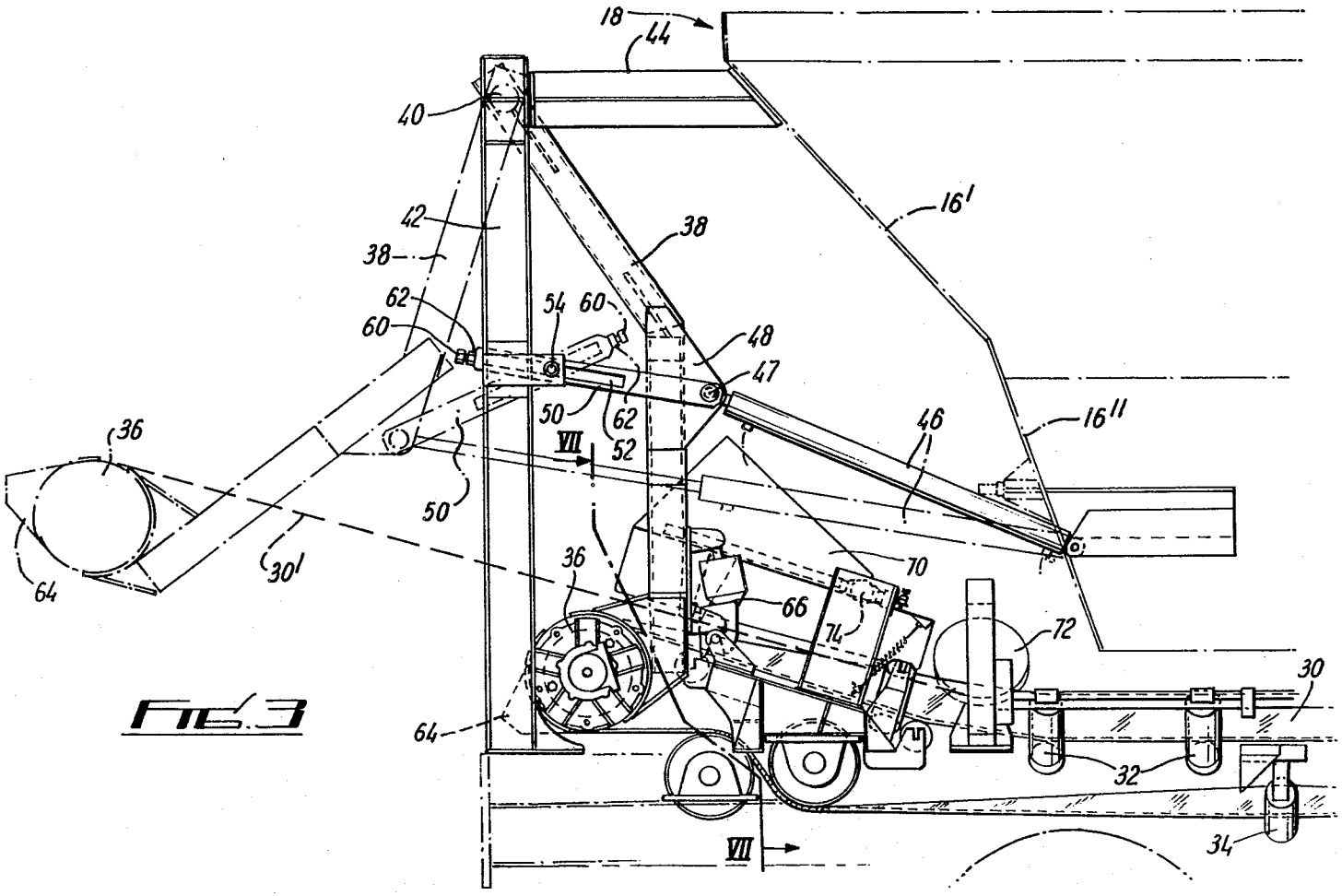
FIG. 3 is a side elevation of one end of a unit.

As illustrated in FIG. 3 the arms 38 and drum 36 held between them can be moved away from the unit, into the position shown in chain dotted lines, by the rams 46. As the rams push the arms 38 clockwise about pivots 40 the link 50 slides on pin 54 and also rotates clockwise about the said pin 54. During this outward movement of arms 38 it will happen that pivot 40, pin 54 and the pivotal connection 47 of link 50 on plate 48 will be in alignment. It is important that in those circumstances the gap between pin 54 and pivotal connection 47 must be bigger than the distance between pivotal connection 47 and the adjacent end of the slot 52. The outward movement of the arms 38 is limited by the engagement of the pins 54 against the ends of their respective slots 52.

For good operation of the belt the axis of drum 36 should be horizontal and at right angles to the direction of travel of the belt. Adjustment to achieve that can be obtained by altering the relative lengths of the slots 52 in each of the links 50. In the illustrated embodiment a bolt 60 fitted with lock nut 62 extends through the end of the link 50 for that purpose.

The drum 36 is fitted with a scraper 64 in order to remove any material on the belt as it travels from the upper run to the lower run. The scraper also serves to retain the belt on the drum 36 this being particularly important when the drum is being withdrawn from its extended position to the normal position (shown in full lines in FIG. 3). A releasable fastening means 66 is provided for holding the arms 38 and drum in the normal position and to prevent undue movement thereof when the wagons are being hauled.

A bin 70 is provided at each end of the unit just above and adjacent the end loop of the endless belt when in the non-extended mode. The bin serves as a funnel or hopper to direct material being received from the endless belt of another adjacently coupled like unit onto the endless belt therebeneath for onward transport.

Figure 7:
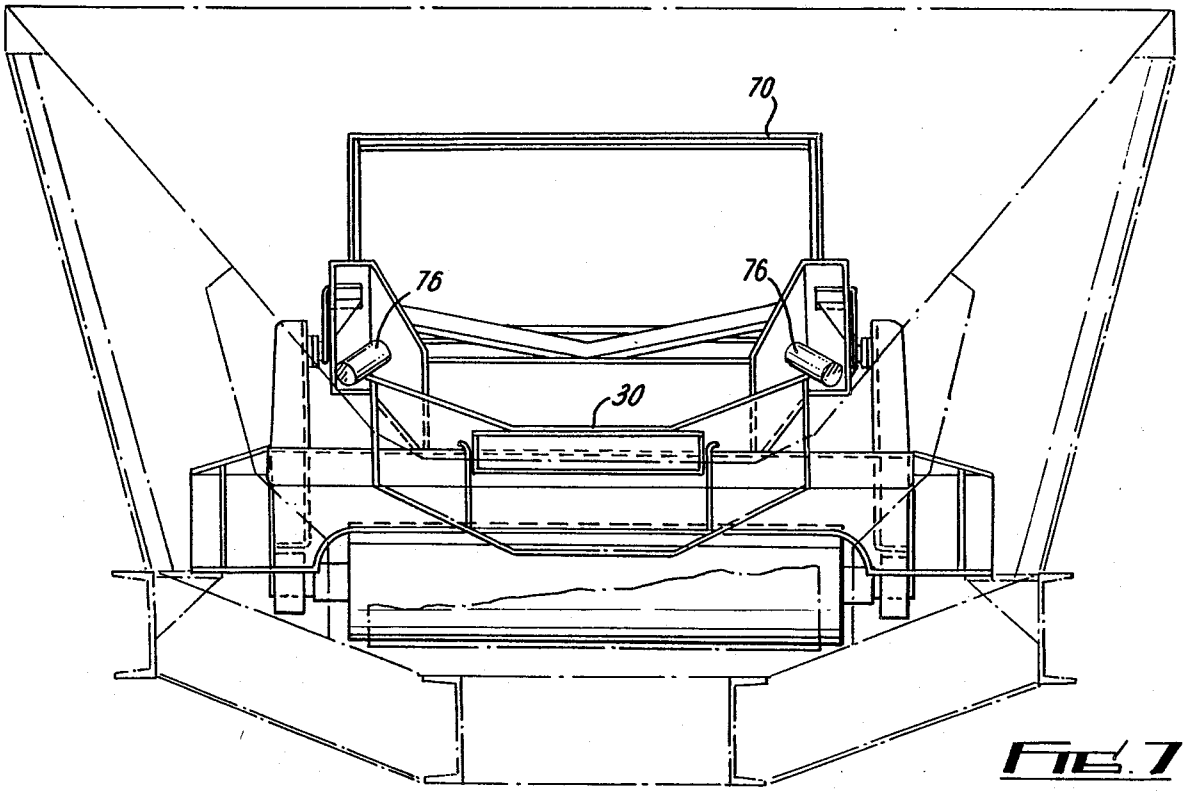
FIG. 7 is a section on the line VII—VII of FIG. 3.
Figure 8:
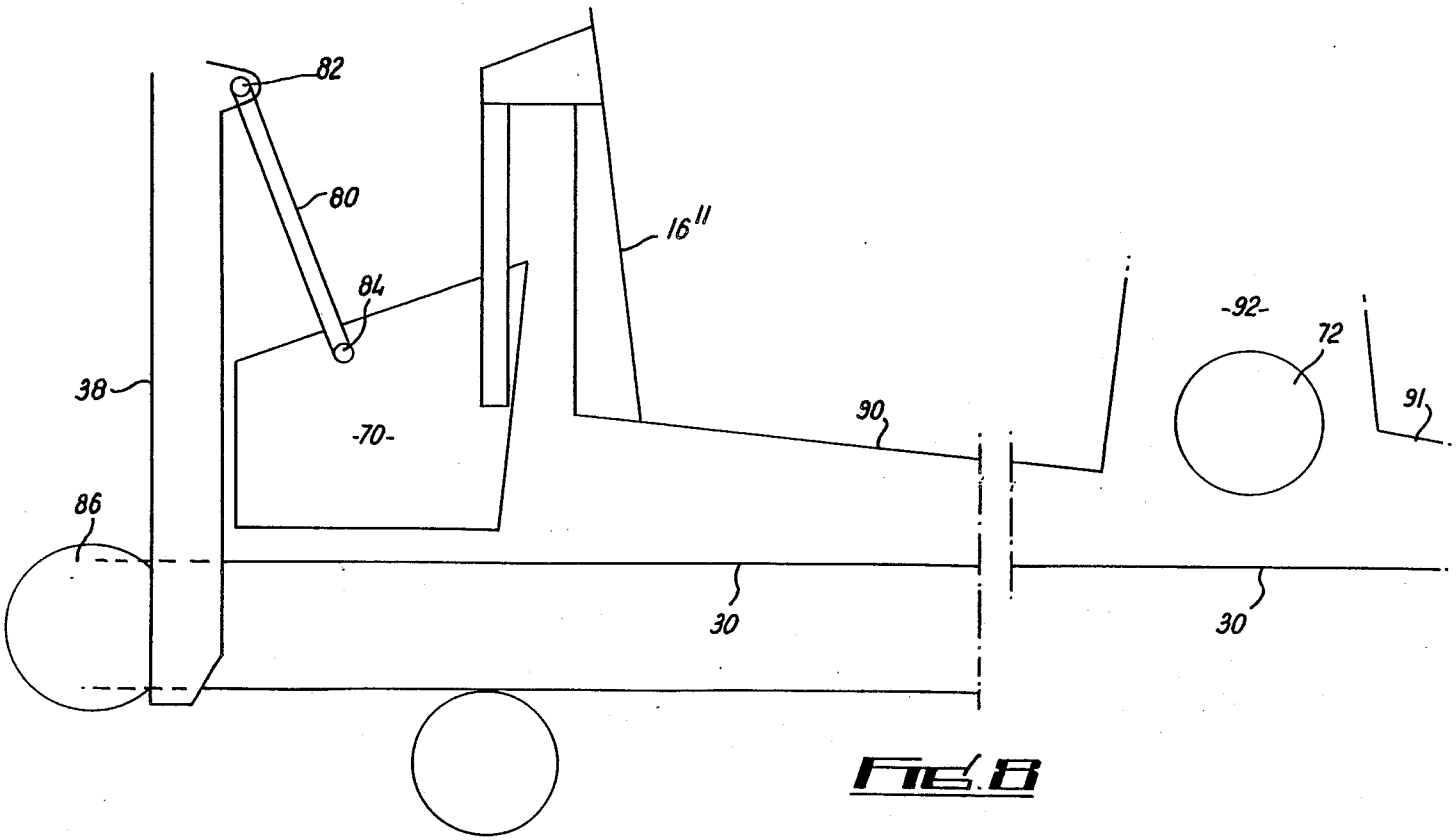
FIG. 8 is a diagrammatic side elevation similar to FIG. 3 of a modified embodiment (some parts being omitted for clarity).

The dotted line 30'in FIG. 3 indicates the disposition of the end of the upper run of the endless belt 30 when the arms 38 and drum are extended. It can be seen that in the extended position the end of the conveyor is raised to a height above the general level of the upper run. To hold the belt down below the hopper wagon bodies guide rollers 72 are provided on both sides of the endless belt just behind the bin 70. In order to prevent the bottom of the bin 70 fouling the belt 30 the bin is pivotally mounted and balanced adjacent the rear thereof as at 74. Rollers 76 mounted on the bin (FIG. 7) on either side edge of the belt 30 and towards the front of the bin can engage and lift the bin by rotation thereof about pivot 74 in response to any upward movement of the upper run of the belt 30 below the bin.

The hopper wagon bodies are closed at the bottom by clam shell gates. The principles of construction and use of clam shell gates is well known and not, therefore, described here. The clam shell gates are operated hydraulically and a motor 80 for that and for operating the rams which extend the arms 38 and drums 36 is provided on end wagon 18.

Figure 2:
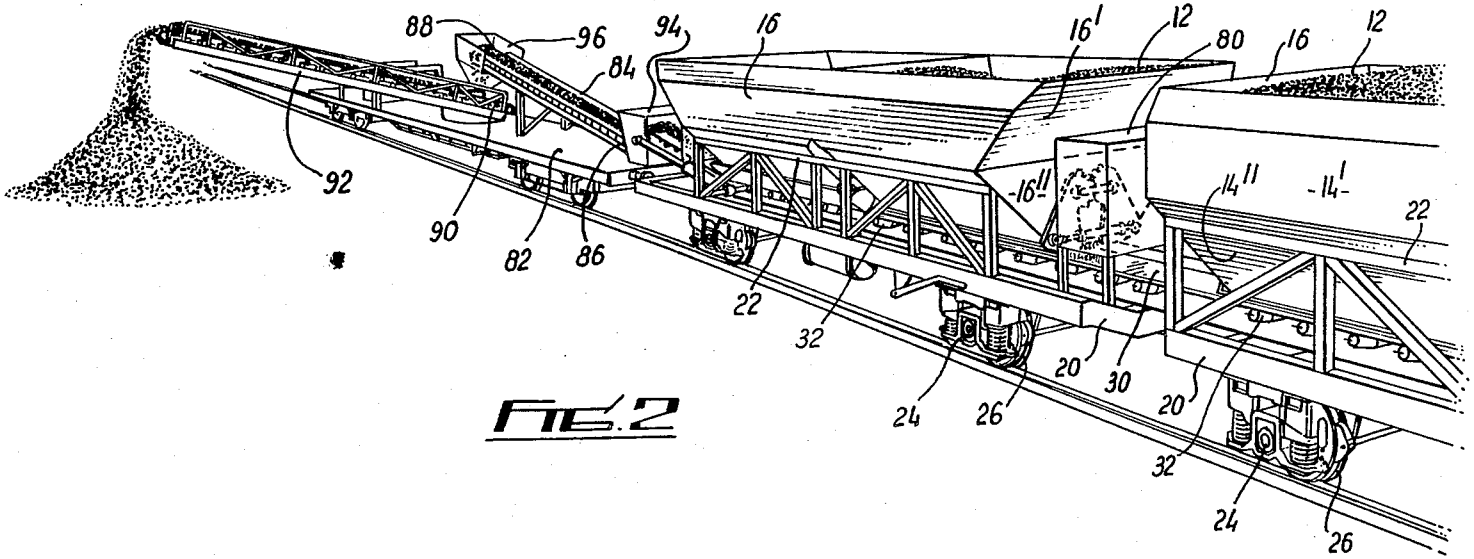
FIG. 2 is a perspective view of one side of the train of FIG. 1 illustrating unloading.

In the embodiment illustrated in FIGS. 1 and 2 a transfer car 82 is loose coupled to one end of the unit. The transfer car includes an inclined first conveyor 84 with its lower end 86 adjacent the end of the transfer car. The upper end 88 of conveyor 84 is positioned above the end 90 of a second conveyor 92. The second conveyor can be swung out to one or other side of the transfer car as illustrated in FIG. 2. Guides 94 and 96 assist respectively reception material onto, and delivery of material from, the conveyor 84.

When the unit or train of units is being moved all the arms 38 and drums 36 are retracted. To unload a unit it is first positioned on a substantially straight length of track. For a unit to be unloaded it is coupled to a transfer car for example as illustrated in FIGS. 1 and 2. The arms 38 and drum adjacent the transfer car are extended so that the end of belt 30 is above the bottom of the conveyor 84. The extended drum 36 is then driven to move the belt 30 and material released onto the belt 30 successively from the wagons in the unit by operation of the clam shell gates. If a second unit is coupled to the first unit, the arms 38 and drum 36 at the end of the second unit are extended so that the said drum on the second unit moves between the non-extended arms 38 at the adjacent end of the first unit and above the end of belt 30 in the first unit. Material from the wagons in the second unit is then successively released onto the belt 30 in the second unit and the material transferred to belt 30 of the first unit and thence to the transfer car for deposition beside the track. When the unit or train of units is empty the extended drums are returned to their normal position.

Figure 4:
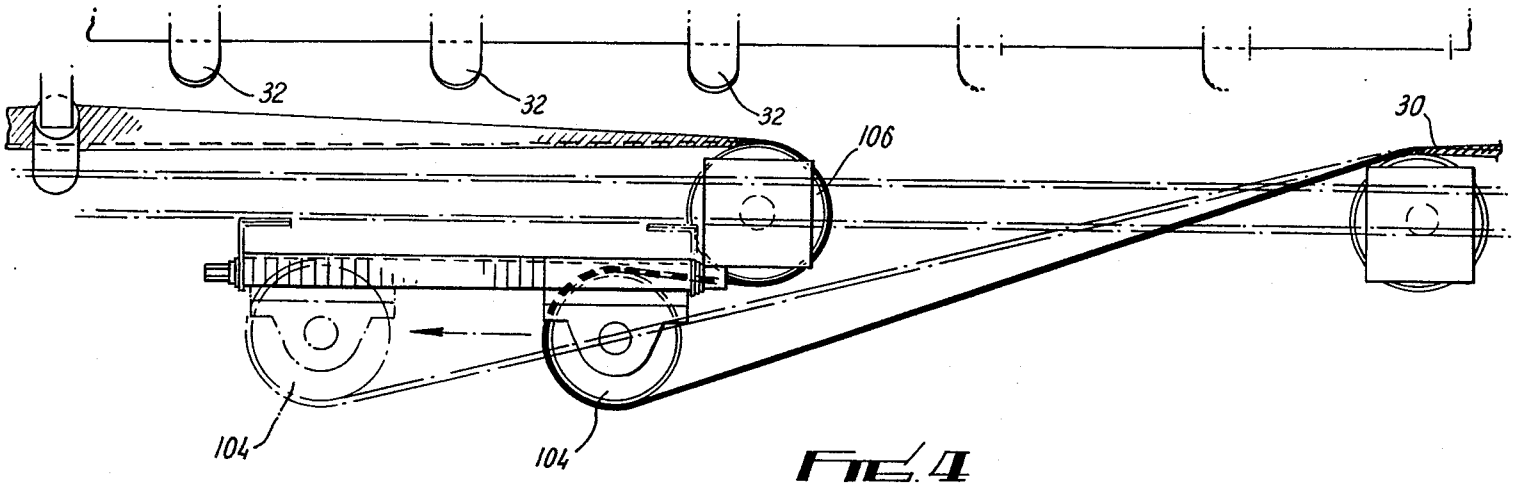
FIG. 4 is a diagrammatic side view of the endless belt tensioning arrangements.
Figure 5:
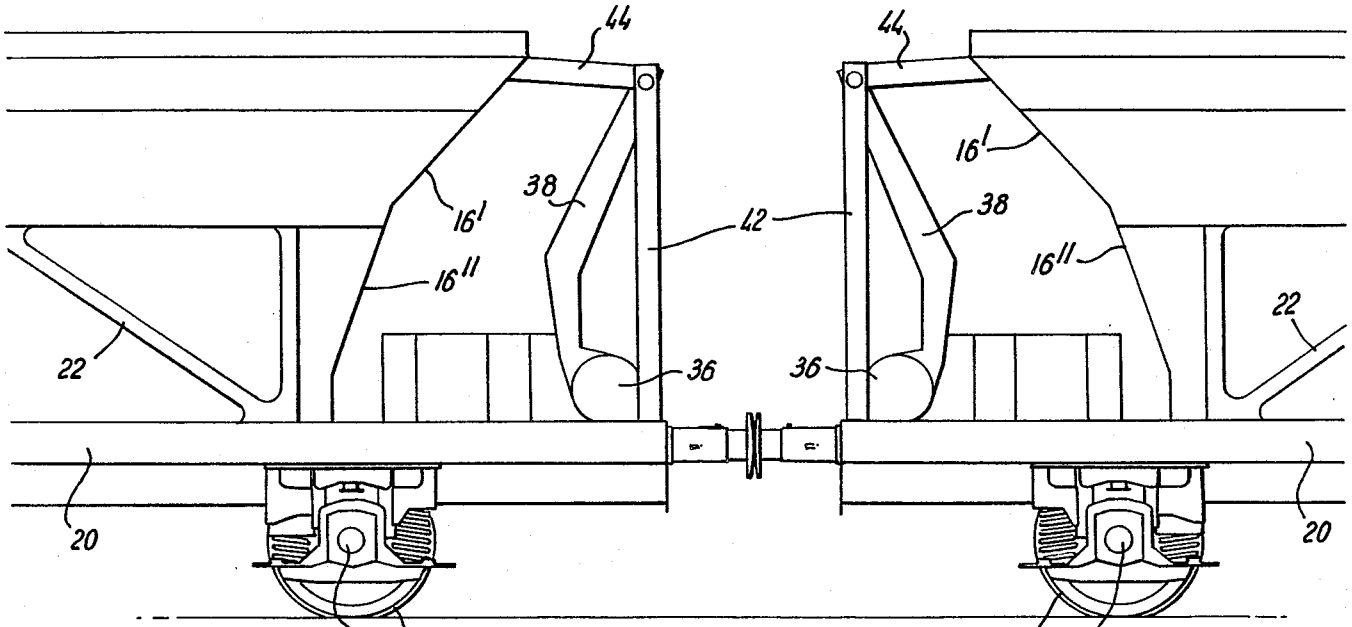
FIG. 5 is a side view with certain parts omitted for clarity of the ends of two units coupled together.

The tension of belt 30 is adjusted by the belt tensioning rollers 104 and 106 which are disposed below the unit and movable towards and away from each other (FIG. 4). The tension is fairly slack when the drums 36 are in their normal position so that the unit can travel around corners. The belt is tightened to its correct tension for unloading by extending the arms 38 and drum 36 at one end only of the unit.

Instead of using the upper run of the endless belt 30 to lift the bin 70 when the arms 38 are moved into the second position the bin 70 can be connected to the arms 38 by links 80 each pivotally connected at one end 82 to an arm 38 and at the other end to a side of the bin.

In addition in order to ensure that the upper run of the belt does not foul the underside of the end hopper, the said underside 90 of the end hopper can be raised above the level 91 of the underside of the other hoppers. The roller 72 is moved from the position shown in FIG. 3 to the tunnel 92 defined between the two hoppers that are provided on the hopper wagon. The purpose of roller 72 is, as before, to prevent the upper run of the belt 30 from being lifted into contact with the underside of the hoppers when the arms 38 are moved into the second position.

The invention is not restricted to the above described embodiments and many variations and modifications can be made. For example a transfer car is not essential to the invention. A unit can be unloaded onto a fixed or other installation.

The bin 70 can, if desired, be omitted altogether and replaced with a short conveyor arranged to run at an angle of about 45°, that is to say roughly along the line of the top edge of the bin as illustrated in FIG. 3. Such a conveyor would not need to be driven but would move in consequence of receiving material thereon from the conveyor 30 of an adjacent unit. The small conveyor replacing bin 70 is preferably mounted on upper and lower rollers, the lowermost roller or rollers replacing rollers 72 as illustrated in FIG. 3.

We claim:

1. A freight discharge assembly for a train of one or more units of one or more mobile freight carriers, comprising a separate endless conveyor belt provided on each unit of said train, means for driving each said endless conveyor in either direction, means provided at each end of each said unit to move the extremity of the endless conveyor loop between a first position adjacent the respective unit and a second position projecting from the respective unit, wherein each said freight carrier comprises means for discharging material downwardly therefrom, and wherein each said endless belt is arranged to run along the respective unit and beneath the carriers of the respective unit so that material discharged from the carriers of the respective unit can fall onto the belt therebeneath under gravity, whereby movement of a said conveyor to said second projecting position permits material discharged from the carriers thereabove to be moved to one end of the respective unit and deposited onto the respective conveyor of the next sequential unit and whereby the material may be discharged from the train at either end thereof.

2. An assembly as claimed in claim 1 wherein the means for moving the conveyor between said first and second positions comprises a roller mounted on at least one arm, said arm being pivotably mounted on the respective unit to move the roller and thereby the end of the conveyor loop.

3. An assembly as claimed in claim 2, wherein the rollers at the ends of the respective unit are selectably drivable in opposite senses and adapted to free-wheel in the reverse direction.

4. An assembly as claimed in claim 1 wherein at least one of the belt tension and the belt length is such that the extremity of each said conveyor loop can only be moved into the second position at one end of the respective unit, but not both ends simultaneously.

5. An assembly as claimed in claim 1 wherein a transfer car is coupled to the last unit of said train, said transfer car including an endless conveyor for moving material received from the conveyor of the last unit to a side of the railway track on which the unit is located.

6. An assembly as claimed in claim 5, wherein an elevator is also provided on the transfer car, said elevator being disposed to receive material falling under gravity from the end of the conveyor of the unit coupled to the said transfer car when said end loop of the conveyor is in the second position and said elevator depositing said material on the said endless conveyor mounted on the transfer car.

7. An assembly as claimed in claim 1, wherein the upper run of the respective endless belt on each said unit is of concave form in transverse section.

8. An assembly as claimed in claim 1, wherein the upper run of the respective endless belt is located above the level of the tops of the wheels of each said unit.

9. An assembly as claimed in claim 1, wherein the extremity of each said endless conveyor loop in the second position is at a height above the general level of the upper run of the endless belt.

* * * * *